US009989261B2

(12) United States Patent
Jeong et al.

(10) Patent No.: US 9,989,261 B2
(45) Date of Patent: Jun. 5, 2018

(54) OVER-THE-RANGE OVEN

(71) Applicant: Samsung Electronics Co., Ltd., Suwon-si (KR)

(72) Inventors: Hee Soo Jeong, Suwon-si (KR); Sang Young So, Seongnam-si (KR); Kyu Ho Shin, Seoul (KR); Byeong Cheol Yoon, Suwon-si (KR); Seok Man Hong, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 469 days.

(21) Appl. No.: 14/492,656

(22) Filed: Sep. 22, 2014

(65) Prior Publication Data

US 2015/0083106 A1 Mar. 26, 2015

(30) Foreign Application Priority Data

Sep. 23, 2013 (KR) ..... 10-2013-0112594

(51) Int. Cl.
*H05B 6/80* (2006.01)
*H05B 6/64* (2006.01)
(Continued)

(52) U.S. Cl.
CPC ..... *F24C 15/322* (2013.01); *F24C 15/2028* (2013.01); *F24C 15/2078* (2013.01); *F24C 15/2092* (2013.01)

(58) Field of Classification Search
CPC ..... F24C 15/322; F24C 15/2092; F24C 15/2078; F24C 15/2028
(Continued)

(56) References Cited

U.S. PATENT DOCUMENTS 3,356,008 A * 12/1967 Simpson ..... F24C 15/2042 126/299 D
3,496,704 A * 2/1970 Bandlow ..... F24C 15/2092 126/299 D
(Continued)

FOREIGN PATENT DOCUMENTS

EP 2 857 759 4/2015
JP 1-114649 5/1989
(Continued)

OTHER PUBLICATIONS

European Office Action dated Jul. 6, 2016 in corresponding European Patent Application No. 14 185 423.2.
(Continued)

*Primary Examiner* — Quang Van
(74) *Attorney, Agent, or Firm* — Staas & Halsey LLP

(57) ABSTRACT

Disclosed herein is an over-the-range oven including a body provided with a suction port and an exhaust port, an air blower unit causing air to be suctioned through the suction port and discharged through the exhaust port, and an air curtain unit movably installed at a lower portion of the body to generate an air curtain by discharging air. Since the air curtain unit is movable between a first position at which the air curtain unit is disposed close to the body and a second position at which the air curtain unit protrudes from the body, it may allow gas produced by a cooking apparatus disposed below the air curtain unit to be efficiently discharged.

18 Claims, 8 Drawing Sheets

(51) Int. Cl.
*F24C 15/20* (2006.01)
*F24C 15/32* (2006.01)

(58) Field of Classification Search
USPC ..... 219/757, 681, 756, 758, 391, 400, 702; 126/273 A, 21 A
See application file for complete search history.

(56) References Cited

U.S. PATENT DOCUMENTS

| | | | | |
|---|---|---|---|---|
| 6,276,358 | B1 | 8/2001 | Brin, Jr. et al. | |
| 2003/0218012 | A1* | 11/2003 | Kim | F24C 15/2042 219/757 |
| 2005/0092745 | A1 | 5/2005 | Yim et al. | |
| 2006/0175322 | A1 | 8/2006 | Beak et al. | |
| 2015/0083106 | A1 | 3/2015 | Jeong et al. | |

FOREIGN PATENT DOCUMENTS

| | | |
|---|---|---|
| KR | 10-2003-0090900 | 12/2003 |
| KR | 10-2005-0090575 | 9/2005 |
| KR | 10-2005-0090576 | 9/2005 |
| KR | 10-2006-0089544 | 8/2006 |
| KR | 10-2010-0009886 | 1/2010 |
| WO | WO 2015/041448 | 3/2015 |

OTHER PUBLICATIONS

Extended European Search Report dated Mar. 10, 2015 in European Patent Application No. 14185423.2.

International Search Report dated Dec. 17, 2014 in International Patent Application PCT/KR2014/008622.

European Office Action dated Dec. 21, 2016 in corresponding European Patent Application No. 14 185 423.2.

Canadian Patent Office Action issued in Canadian Patent Application No. 2,923,417 dated Mar. 21, 2017 (3 pages).

European Office Action dated Jun. 12, 2017 in corresponding European Patent Application 14 185 423.2.

Office Action dated Feb. 26, 2018 issued in Canadian Patent Application No. 2,923,471 (3 pages).

* cited by examiner

OVER-THE-RANGE OVEN

CROSS-REFERENCE TO RELATED APPLICATIONS

This application claims the priority benefit of Korean Patent Application No. 10-2013-0112594, filed on Sep. 23, 2013 in the Korean Intellectual Property Office, the disclosure of which is incorporated herein by reference.

BACKGROUND

1. Field

Embodiments relate to an over-the-range oven that is disposed over a cooking apparatus to function as a hood and a oven for cooking of food.

2. Description of the Related Art

Ovens are appliances that cook food by heating food placed in a cooking chamber provided in the body of the microwave oven.

The ovens include an electric oven that heats food with heat generated by electricity, a gas oven that heats food with heat generated by burning gas, and a microwave oven that heats food with frictional heat generated through translational movement of water particles caused by radiating high frequency waves.

Among such ovens is an over-the-range microwave oven, which is disposed over a cooking apparatus such as a gas range to suction various gases produced during operation of the cooking apparatus and discharge the same to the outdoors.

SUMMARY

In an aspect of one or more embodiments, there is provided an over-the-range oven which may efficiently suction gases produced by a cooking apparatus arranged under the over-the-range oven and discharge the same outdoors.

In an aspect of one or more embodiments, there is provided an over-the-range oven which includes a body including a suction port and an exhaust port, an air blower unit causing air to be suctioned through the suction port and discharged through the exhaust port, and an air curtain unit to generate an air curtain by discharging air, wherein the air curtain unit moves between a first position and a second position, the air curtain unit being disposed close to the body at the first position and generating the air curtain when protruding from the body to the second position.

When the air curtain unit is at the second position, the air curtain unit may generate the air curtain to guide a gas produced by a cooking apparatus positioned below the body during cooking to the suction port.

The air curtain unit may include at least one guide extending in a front-to-back direction and installed at the body to be movable back and forth, and a discharge portion connected to a front end of the at least one guide and extending laterally, wherein the discharge portion may include at least one discharge port allowing air to be discharged therethrough.

The at least one guide may include a pair of guides extending in a front-to-back direction and movably installed at both sides of a lower portion of the body, and both ends of the discharge portion may be connected to front ends of the guides.

The guides and the discharge portion may be hollow to allow air to pass therethrough, wherein a portion of the air discharged from the air blower unit may pass through the guides and the discharge portion and be discharged through the discharge port.

The discharge portion may be formed in a shape of a square duct, wherein the discharge port may be formed in a rear surface of the discharge portion to extend laterally.

The at least one guide may comprise one guide which may be formed in a plate shape, wherein the discharge portion may extend downward from the front end of the one guide, wherein the discharge port may be formed in a rear surface of the discharge portion to extend laterally.

The guide and the discharge portion may be hollow to allow air to pass therethrough, wherein a portion of the air discharged from the air blower unit may pass through the guide and the discharge portion and be discharged through the discharge port.

The over-the-range oven may further including an air blowing fan to suction and blow air, wherein the discharge portion may be hollow to allow the air blowing fan to be installed in the discharge portion.

The discharge portion may further include a suction port allowing air to be suctioned therethrough.

The discharge portion may be formed in a shape of a square duct, wherein the suction port may be formed in a lower surface of the discharge portion, and the discharge port may be formed in a rear surface of the discharge portion.

The air blowing fan may include a crossflow fan disposed in the discharge portion to extend laterally.

The suction port may be disposed at a lower portion of the body, wherein the air blower unit may be disposed at the lower portion of the body and adjacent to the suction port.

The exhaust port may be arranged at a rear side of an upper surface of the body, wherein the air blower unit may be disposed inside the exhaust port.

In an aspect of one or more embodiments, there is provided an over-the-range oven which includes a body including a suction port to suction air and an exhaust port to discharge air, an air blower unit disposed in the body to cause the air to be suctioned through the suction port and discharged through the exhaust port, and an air curtain unit to generate an air curtain by protruding forward from the body and horizontally discharging the air.

The air curtain unit may be installed to be movable toward the body and away from the body.

The air curtain unit may include a pair of guides extending in a front-to-back direction and installed at both sides of a lower portion of the body, and a discharge portion extending laterally and provided with a discharged port for discharge of air formed in a rear surface of the discharged portion, both side ends of the discharge portion being connected to front ends of the guides. The guides and the discharge portion may be hollow to guide air therethrough.

The air curtain may include a guide formed in a plate shape and installed at a lower portion of the body, and a discharge portion extending downward form the guide and provided with a discharge port for discharge of air formed in a rear surface of the discharge portion. The guide and the discharge portion may be hollow to guide air therethrough.

The over-the range oven may include an air blowing fan to suction and blow air. The air curtain may include a pair of guides extending in a front-to-back direction and movably installed at both sides of the body, and a discharge portion extending laterally, both side ends of the discharge portion being connected to front ends of the guides. The discharge portion may be hollow to allow installation of the air blowing fan therein and provided with a suction port formed in a lower surface of the discharge portion to suction air and a discharge port formed in a rear surface thereof to discharge the air.

In an aspect of one or more embodiments, there is provided an over-the-range oven including a body provided with a suction port and an exhaust port; an air blower unit causing air to be suctioned through the suction port and discharged through the exhaust port; and an air curtain unit to generate an air curtain by discharging air, wherein: the air curtain unit moves between a first position and a second position, the air curtain unit being disposed close to the body at the first position and generating the air curtain when protruding from the body to the second position, the air curtain unit comprises at least one guide extending in a front-to-back direction and installed at the body to be movable back and forth, and a discharge portion connected to a front end of the at least one guide and extending laterally, and the discharge portion comprises a plurality of discharge ports allowing air to be discharged therethrough.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
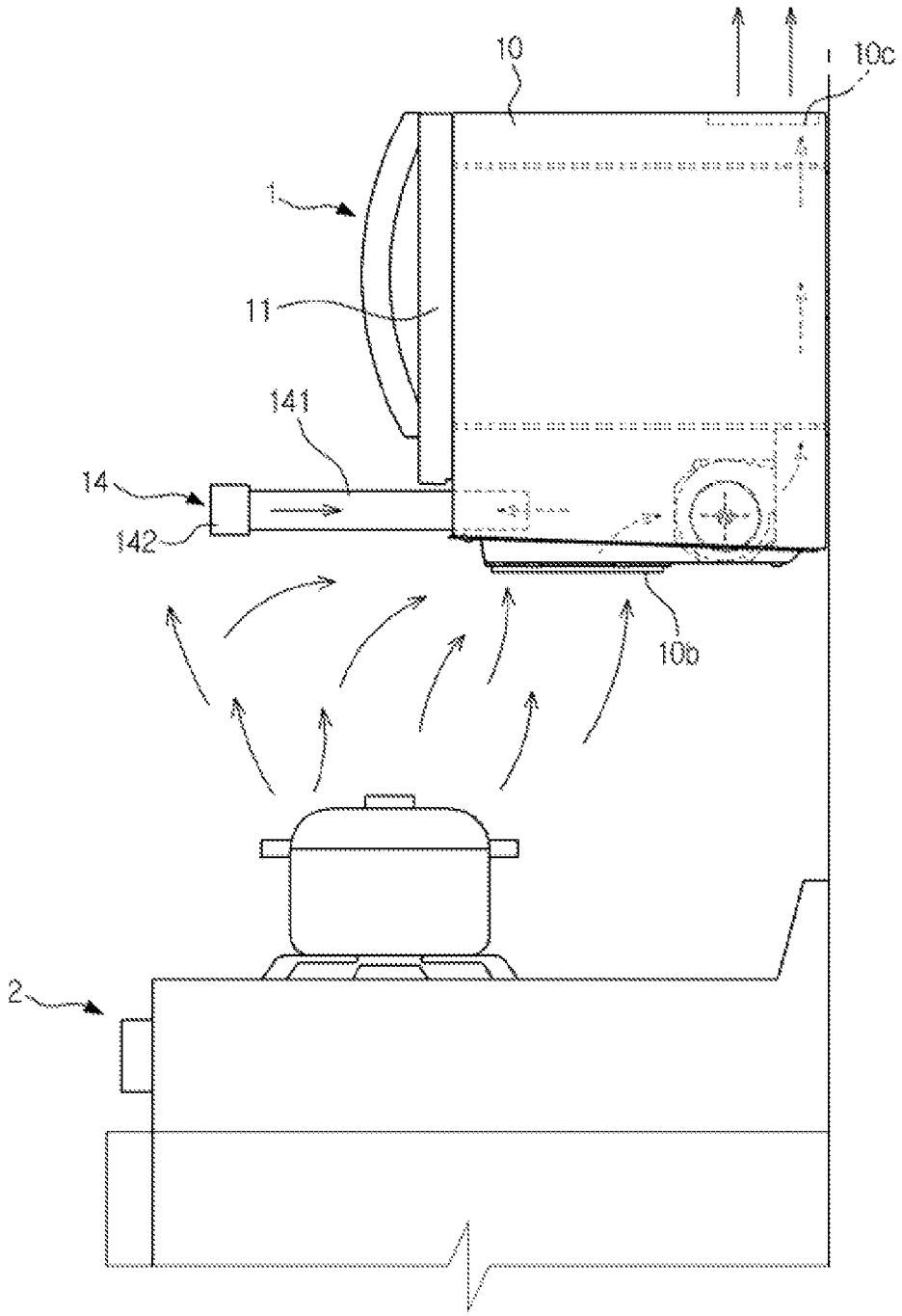
FIG. 1 is a side view illustrating installation of an over-the-range oven according to an exemplary embodiment.

Reference will now be made in detail to embodiments, examples of which are illustrated in the accompanying drawings, wherein like reference numerals refer to like elements throughout.

As shown in FIG. 1, an over-the-range oven 1 according to an embodiment is disposed over and spaced from a cooktop type cooking apparatus 2 such as a gas range.

Figure 2:
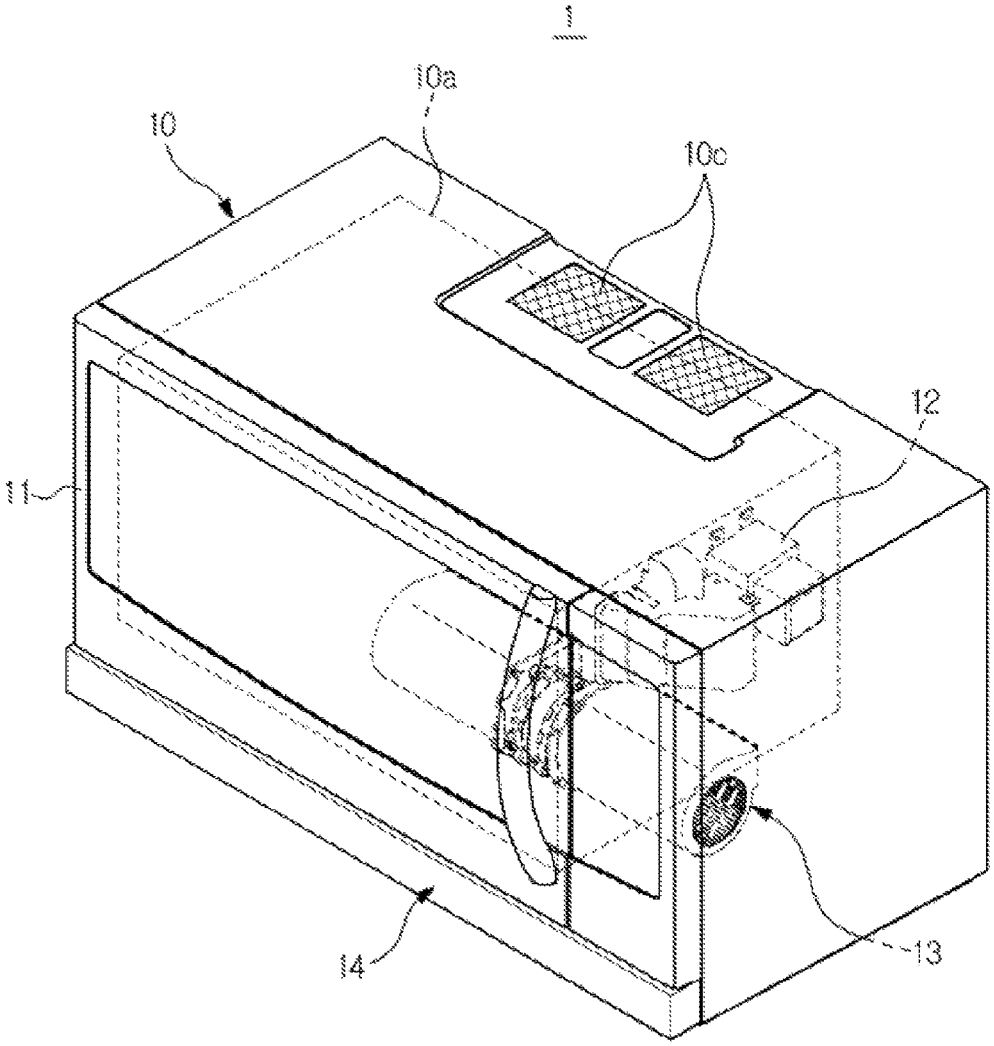
FIG. 2 is a perspective view illustrating the over-the-range oven of FIG. 1.
Figure 3:
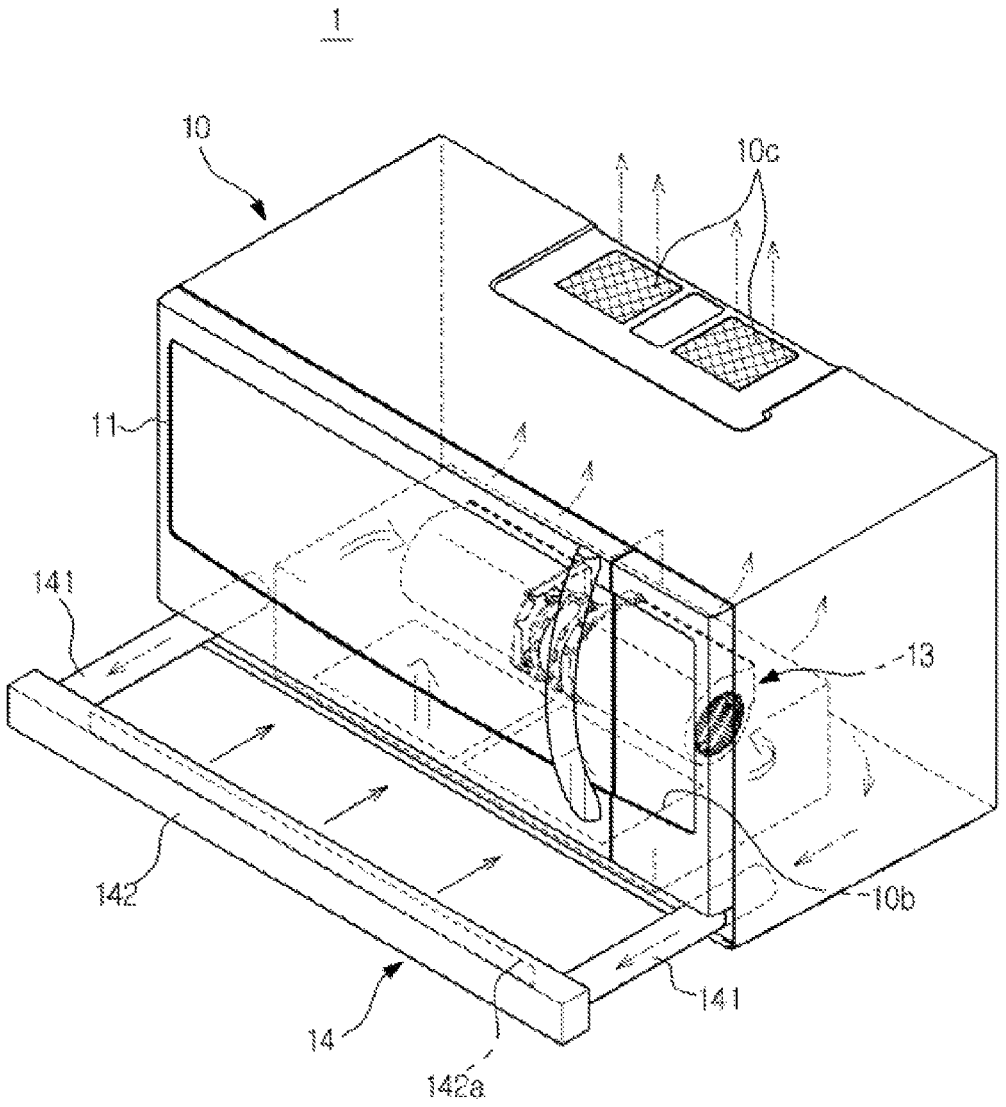
FIG. 3 is a perspective view illustrating operation of the over-the-range oven of FIG. 1.

As shown in FIGS. 2 and 3, the over-the-range oven 1 includes a body 10 formed approximately in the shape of a rectangular parallelepiped and fixed to a wall of a building.

The body 10 is provided therein with a cooking chamber 10*a* to accommodate food to be cooked, and a door 11 to open and close the cooking chamber 10*a* is installed at the front of the body 10. In an embodiment, the over-the-range oven 1 is provided as a microwave oven including a magnetron 12 disposed at one side of the cooking chamber 10*a* and adapted to cook food through electromagnetic waves generated by the magnetron 12.

The body 10 includes a suction port 10*b* provided at the center of the lower surface of the body 10 and an exhaust port 10*c* provided at the rear side of the upper surface of the body 10. An air blower unit 13 is disposed in the body 10 to cause air to be suctioned through the suction port 10*b* and discharged through the exhaust port 10*c*. The exhaust port 10*c* is connected to an exhaust duct (not shown) provided to a wall of a building for emission of air.

Thereby, gases produced by the cooking apparatus 2 and air are suctioned together into the body 10 through the suction port 10*b* provide in the lower surface of the body 10 and discharged through the exhaust port 10*c* provided in the upper surface of the body 10 via a flow passage provided in the body 10. Accordingly, the over-the-range oven 1 functions both as an oven and a hood.

The over-the-range oven 1 includes an air curtain unit 14 to discharge air in a straight line to generate an air curtain and guide various gases produced by the cooking apparatus 2 below the oven 1 to the suction port 10*b*. The air curtain unit 14 is installed at the lower portion of the body 10 such that it is movable back and forth. Thereby, it may move between a first position, at which the air curtain unit 14 is disposed close to the body 10, and a second position, at which the air curtain unit 14 protrudes from the body 10. The air curtain unit 14 may touch the body 10 at a first position or may almost touch the body 10 at a first position.

Accordingly, in the case that cooking is not conducted on the cooking apparatus 2 arranged below the oven, the air curtain unit 14 is maintained at the first position as shown in FIG. 2. In the case that a gas produced by the cooking apparatus 2 needs to be discharged outside, the air curtain unit 14 is moved to the second position as shown in FIG. 3 such that an air curtain is created by the air curtain unit 14. Thereby, gas produced by the cooking apparatus 2 is guided to the suction port 10*b* of the body 10 by the air curtain produced by the air curtain unit 14.

In an embodiment shown in FIG. 3, the air curtain unit 14 includes a guide 141 formed in the shape of a bar extending forward and installed at a lower portion of the body 10 to be movable back and forth, and a discharge portion 142 connected to the front end of the guide 141 and extending in a lateral direction. The discharge portion 142 is provided with a discharge port 142*a* through which air is discharged.

The guide 141 and discharge portion 142 are hollow so as to guide air discharged from the air blower unit 13 to the discharge port 142*a*. In an embodiment, a pair of guides 141 formed in the shape of a circular duct is provided, and the discharge portion 142 is formed in the shape of a square duct. Both side ends of the discharge portion 142 are connected to the front ends of the two guides 141.

The guides 141 allow the air curtain unit 14 to be movably installed at the body 10 and functions to guide the air blown by the air blower unit 13 to both sides of the discharge portion 142 in the body 10. The discharge port 142*a* is formed in the rear surface of the discharge portion 142 and extends laterally.

Accordingly, when the air blower unit 13 in the body 10 operates, air below the body 10 is suctioned into the body 10 through the suction port 10*b*. The air suctioned into the body 10 is blown by the air blower unit 13. Thereby, most of the suctioned air is discharged into the exhaust duct in the building through the exhaust port 10*c*, and the remaining portion of the suctioned air passes through the guides 141 and discharge portion 142 and creates an air curtain by being discharged through the discharge port 142*a* provided in the discharge portion 142.

When the air curtain is created with the air curtain unit 14 protruding forward of the body 10 as described above, a major portion of the gas moving upward from the space below the air curtain unit 14 is moved backward by the air curtain created by the air curtain unit 14. Since the body 10 is positioned at the back of the air curtain unit 14, and the suction port 10*b* is formed in the lower surface of the body 10, the gas moved backward is suctioned into the body 10 through the suction port 10*b* and is then discharged from the body 10 through the exhaust port 10*c*.

Accordingly, the amount of gas suctioned through the suction port 10*b* of the body 10 by the air curtain unit 14 protruding forward from the body 10 may be increased. In addition, since the gas ascending toward the front of the body 10 may be guided to the suction port 10*b* positioned at the rear side of the body 10, the hood function of the over-the-range oven 1 may be enhanced by the air curtain unit 14.

In an embodiment, the air curtain unit 14 includes a pair of guides 141 and a discharge portion 142 connected to the front ends of the two guides 141. However, embodiments are not limited thereto. In an over-the-range oven 1-1 according to an embodiment as shown in FIGS. 4 and 5, an air curtain unit 14-1 may be provided with a guide 141-1 formed in a plate shape, a discharge portion 142-1 extending downward from the front end of the guide 141-1, and a discharge port 142*a*-1 formed in the rear surface of the discharge portion 142-1 in a manner that the discharge port 142*a*-1 laterally extends.

The guide 141-1 and the discharge portion 142-1 are hollow to guide air therethrough, and the discharge port 142*a*-1 is formed in the rear surface of the discharge portion 142-1. Accordingly, the air blown by air blower unit 13 passes through the hollow of the guide 141-1 and discharge portion 142-1 and creates an air curtain by being horizontally discharged backward through the discharge port 142*a*-1.

Figure 4:
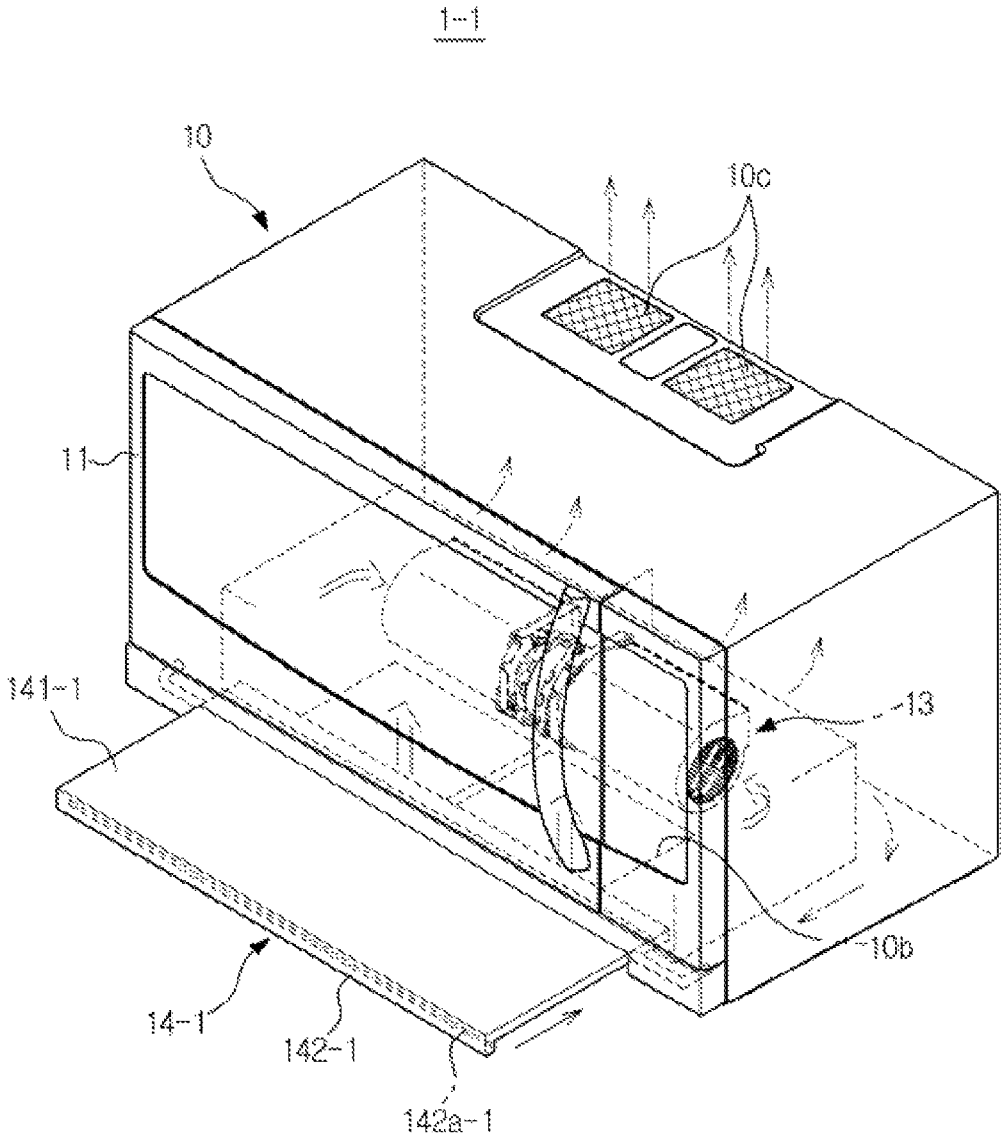
FIG. 4 is a perspective view illustrating an over-the-range oven according to an exemplary embodiment.
Figure 5:
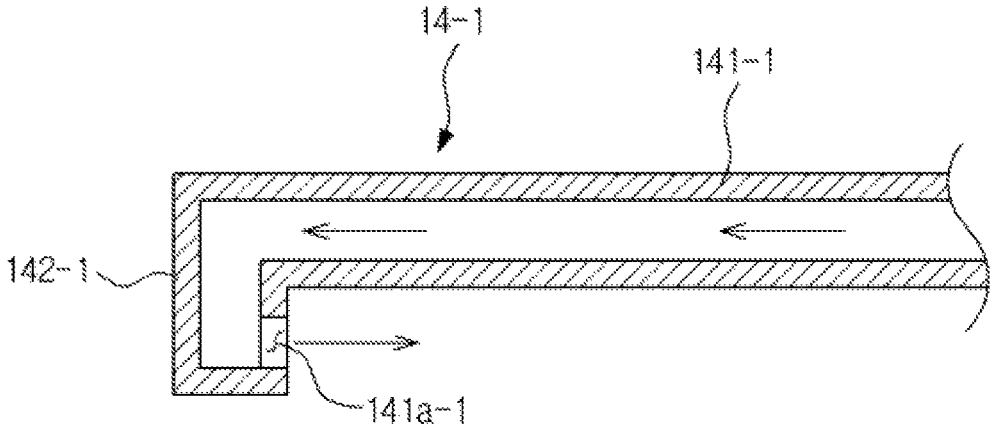
FIG. 5 is a cross-sectional view illustrating an air curtain unit applied to the over-the-range oven of FIG. 4.

In an embodiment in which the guide 141-1 is formed in a plate shape as shown in FIG. 4, ascending of a gas produced by the cooking apparatus 2 below the over-the-range oven 1-1 toward the front space of the body 10 is blocked by the guide 141-1, and thus the gas is moved backward by the air curtain produced by the air curtain unit 14-1. Accordingly, the gas produced by the cooking apparatus 2 may be more efficiently guided to the suction port 10*b* of the body 10.

In one or more embodiments, the air curtain unit 14-1 creates an air curtain by receiving a portion of air blown by the air blower unit 13 disposed in the body 10. However, embodiments are not limited thereto.

Figure 6:
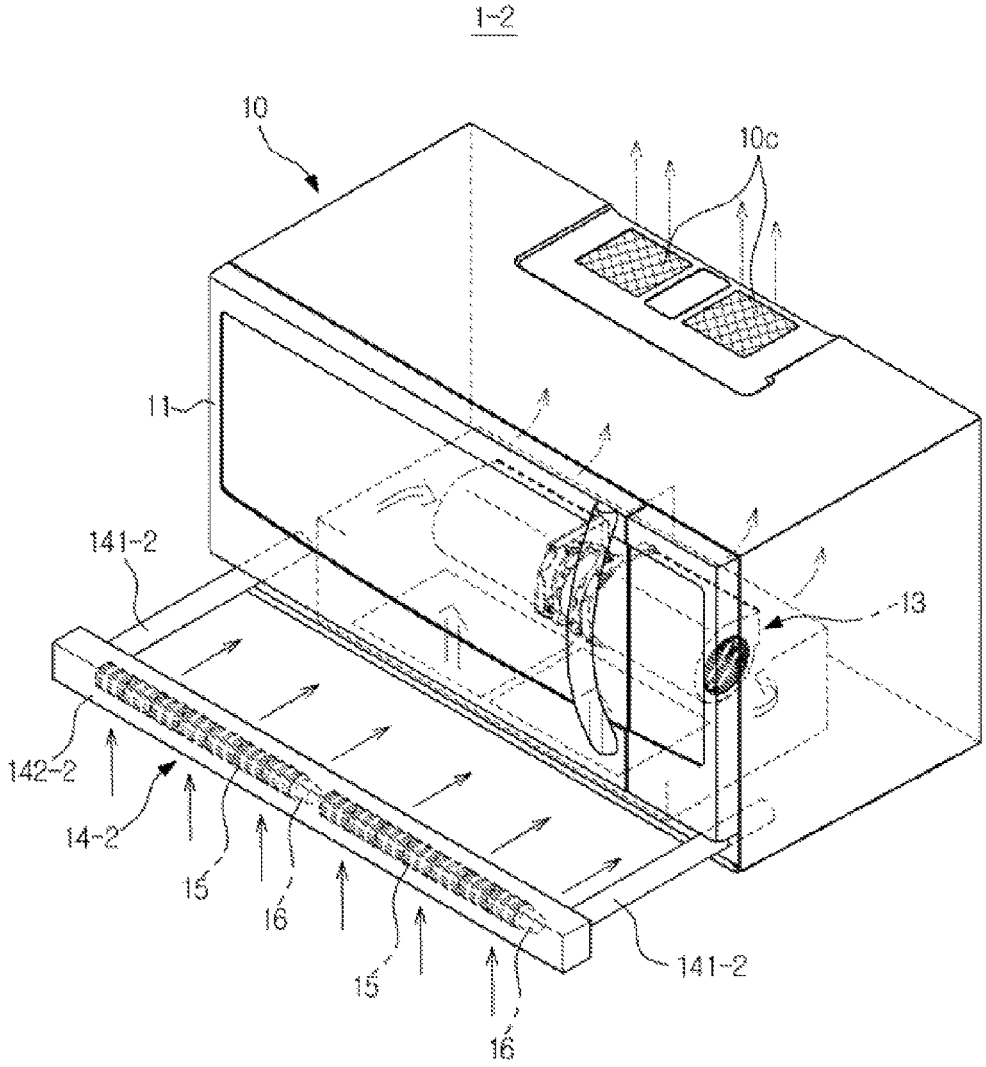
FIG. 6 is a perspective view illustrating an over-the-range oven according to an exemplary embodiment.
Figure 7:
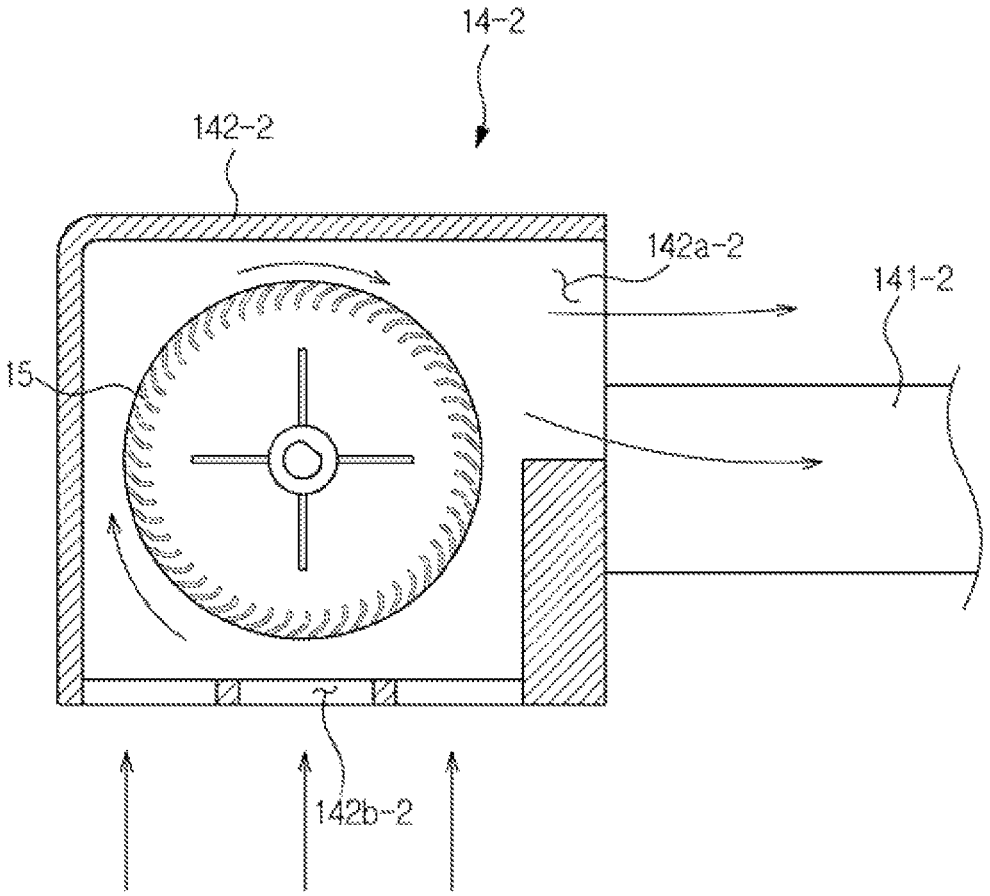
FIG. 7 is a cross-sectional view illustrating an air curtain unit applied to the over-the-range oven of FIG. 6.

FIGS. 6 and 7 illustrate an over-the-range oven 1-2 according to an embodiment.

An air curtain unit 14-2 is movably installed at a lower portion of the body 10. The air curtain unit 14-2 includes a pair of guides 141-2 and a discharge portion 142-2 connected to the front ends of the two guides 141-2.

The discharge portion 142-2 is hollow, and a suction port 142*b*-2 to suction air is formed in the lower surface of the discharge portion 142-2. Disposed in the hollow inner space of the discharge portion 142-2 are an air blowing fan 15 to suction and discharge air through rotation and a drive motor 16 to rotate the air blowing fan 15. In an embodiment shown in FIG. 6, the air blowing fan 15 is implemented as a crossflow fan extending laterally in the discharge portion 142-2. The air blowing fan 15 suctions air through the suction port 142*b*-2 at the lower side of the air blowing fan 15 and discharges the suctioned air through the discharge port 142*a*-2 at the back of the discharge portion 142-2, thereby creating an air curtain. In an embodiment, two air blowing fans 15 and two drive motors 16 are provided.

As the air blowing fans 15 and drive motors 16 are installed in the discharge portion 142-2, a portion of the gas produced by the cooking apparatus 2 moving upward and air are suctioned into the discharge portion 142-2 and discharged backward through the discharge port 142*a* by the air blowing fans 15. Therefore, the hood function of the over-the-range oven 1-2 may be enhanced by the air curtain unit 14-2.

Figure 8:
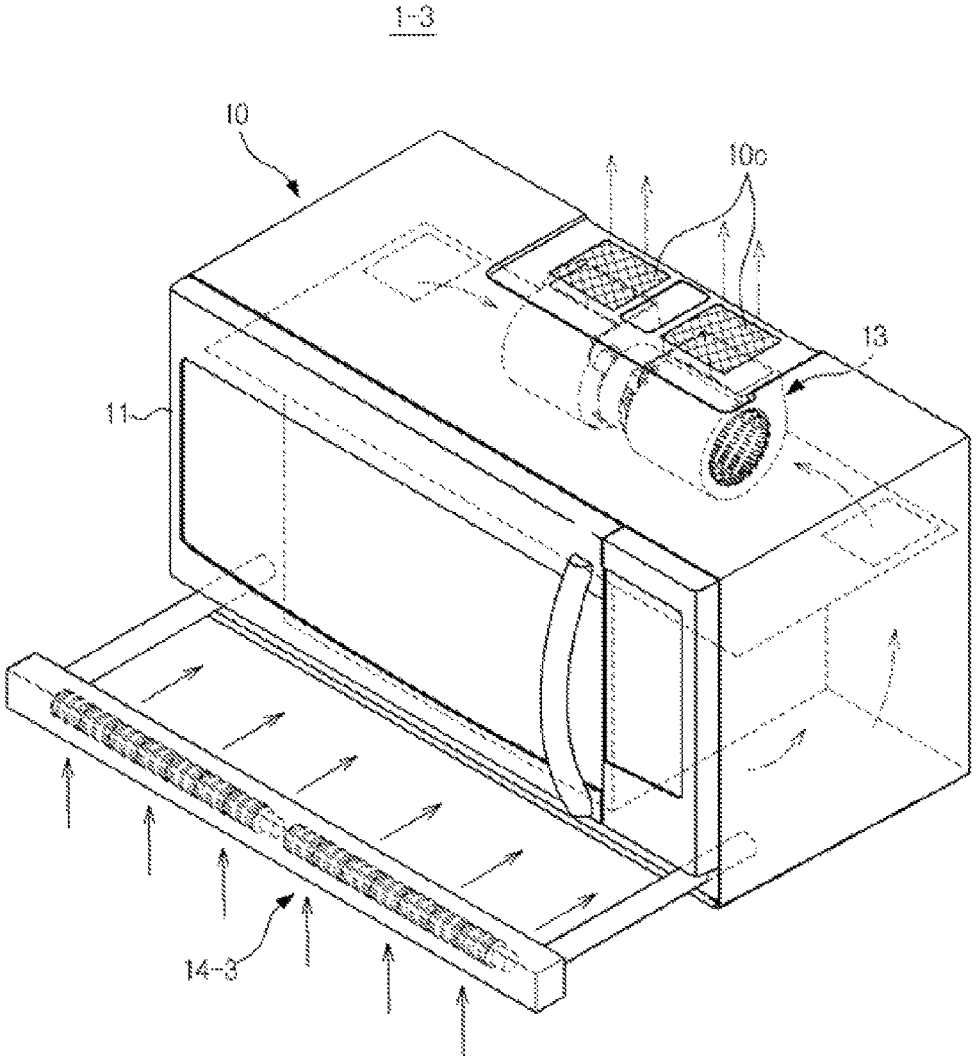
FIG. 8 is a perspective view illustrating an over-the-range oven according to an exemplary embodiment.

While the air blower unit 13 is illustrated as being disposed adjacent to the suction port 10*b* formed at the lower portion of the body 10, embodiments are not limited thereto. As shown in FIG. 8, the air blower unit 13 may be disposed inside an exhaust port 10*c* formed in the upper surface of the body 10.

In one or more embodiments, the air curtain units 14, 14-1 and 14-2 are movably installed at the body 10 to protrude from the body 10 through movement. However, embodiments are not limited thereto. They may be rotatably installed at the body 10 to protrude from the body 10 by rotating. In addition, the air curtain unit 14 may be securely installed such that the discharge portion 142 of the air curtain unit 14 remains protruded forward of the body 10.

As is apparent from the above description, an over-the-range oven according to one or more embodiments may allow gas produced by a cooking apparatus arranged below an air curtain unit of the oven to be efficiently discharged by guiding the gas to a suction port formed in a lower surface of the body of the oven through an air curtain created by the air curtain unit.

Although a few embodiments have been shown and described, it would be appreciated by those skilled in the art that changes may be made to embodiments without departing from the principles and spirit of the disclosure, the scope of which is defined in the claims and their equivalents.

What is claimed is:

1. An over-the-range oven comprising:

a body including:

a suction port provided on a lower surface of the body; and an exhaust port;

an air blower unit causing air to be suctioned through the suction port and discharged through the exhaust port; and an air curtain unit movable in a forward direction and a backward direction with respect to the body, the air curtain unit comprising:

at least one guide having both ends thereof open to allow the air to move therethrough; and a discharge portion connected to one end of the at least one guide to receive the air from the at least one guide therethrough, the discharge portion comprising a discharge port opened toward the body to discharge the air received from the at least one guide toward the body, thereby generating air curtain flowing from the discharge port to the body, wherein, when the air curtain unit is open and the air curtain is generated, gas generated by a cooking apparatus positioned below the body is guided to the body by the air curtain when the gas contacts the air curtain and discharged through the exhaust port by the air blower unit, and wherein, when the air curtain unit moves in the forward direction and the air curtain is generated, gas generated by a cooking apparatus positioned below the body is guided to the suction port by the air curtain when the gas contacts the air curtain and discharged through the exhaust port by the air blower unit.

2. The over-the-range oven according to claim 1, wherein:
the at least one guide comprises a pair of guides extending in the forward and backward direction and movably installed at both sides of a lower portion of the body; and
both ends of the discharge portion are connected to front ends of the guides.

3. The over-the-range oven according to claim 2, wherein the guides and the discharge portion are hollow therein, respectively to allow air to pass therethrough, and a portion of the air discharged from the air blower unit passes through the guides and the discharge portion and is discharged through the discharge port.

4. The over-the-range oven according to claim 3, wherein the discharge portion is formed in a shape of a square duct, and the discharge port is formed in a rear surface of the discharge portion to extend laterally.

5. The over-the-range oven according to claim 1, wherein:
the at least one guide comprises one guide which is formed in a plate shape,
the discharge portion extends downward from the front end of the one guide, and
the discharge port is formed in a rear surface of the discharge portion to extend laterally.

6. The over-the-range oven according to claim 5, wherein:
the guide and the discharge portion are hollow to allow air to pass therethrough, and
a portion of the air discharged from the air blower unit passes through the one guide and the discharge portion and is discharged through the discharge port.

7. The over-the-range oven according to claim 1, further comprising an air blowing fan to suction and blow air,
wherein the discharge portion is hollow to allow the air blowing fan to be installed in the discharge portion.

8. The over-the-range oven according to claim 7, wherein the discharge portion further comprises a suction port allowing air to be suctioned therethrough.

9. The over-the-range oven according to claim 8, wherein:
the discharge portion is formed in a shape of a square duct,
the suction port is formed in a lower surface of the discharge portion, and
the discharge port is formed in a rear surface of the discharge portion.

10. The over-the-range oven according to claim 9, wherein the air blowing fan comprises a crossflow fan disposed in the discharge portion to extend laterally.

11. The over-the-range oven according to claim 1,
wherein the suction port is disposed at a lower portion of the body, and the air blower unit is disposed at the lower portion of the body and adjacent to the suction port.

12. The over-the-range oven according to claim 1, wherein the exhaust port is disposed at a rear side of an upper surface of the body, and
the air blower unit is disposed inside the exhaust port.

13. The over-the-range oven according to claim 1, wherein the at least one guide includes a pair of guides and connected to both ends of the discharge portion, respectively, so that the discharge port is formed between the pair of guides, thereby generating the air curtain between the pair of guides.

14. The over-the-range oven according to claim 13, wherein the discharged port is horizontally extended between the pair of guides so that the air curtain flows horizontally from the discharge port to the body.

15. An over-the-range oven comprising:
a body including a suction port to suction air and an exhaust port to discharge air;
an air blower unit disposed in the body to cause the air to be suctioned through the suction port and discharged through the exhaust port; and
an air curtain unit protruding forward with respective to the body, the air curtain unit comprises:
a pair of guides extending in a front-to-back direction and having both ends thereof open to allow the air to move therethrough, respectively, the pair of guides respectively installed at both sides of a lower portion of the body; and
a discharge portion extending horizontally and both ends of the discharge portion being connected to front ends of the pair of guides to receive the air from the from the pair of guides, respectively, the discharge portion having a discharge port extending horizontally and formed between the pair of guides and opened toward the body to discharge the air received from the pair of guides toward the body, thereby generating air curtain flowing horizontally from the discharge port to the body,
wherein, when the air curtain unit protrudes forward and the air curtain is generated, gas generated by a cooking apparatus positioned below the body is guided to the suction port by the air curtain when the gas contacts the air curtain and discharged through the exhaust port by the air blower unit.

16. The over-the-range oven according to claim 15, wherein the air curtain unit is installed to be movable toward the body and away from the body.

17. The over-the-range oven according to claim 15, wherein the guides and the discharge portion are hollow therein to guide air therethrough.

18. The over-the-range oven according to claim 15, further comprising an air blowing fan to suction and blow air,
wherein the discharge portion is hollow to allow installation of the air blowing fan therein and provided with a suction port formed in a lower surface of the discharge portion to suction air and a discharge port formed in a rear surface thereof to discharge the air.

* * * * *